United States Patent [19]

Potter et al.

[11] 4,299,542

[45] Nov. 10, 1981

[54] FUEL INJECTION PUMPING APPARATUS

[75] Inventors: James C. Potter; Stanislaw J. A. Sosnowski, both of London, England

[73] Assignee: Lucas Industries Limited, Birmingham, England

[21] Appl. No.: 65,546

[22] Filed: Aug. 10, 1979

[30] Foreign Application Priority Data

Sep. 15, 1978 [GB] United Kingdom ..... 36973/78

[51] Int. Cl.[3] ..... F04B 49/06; F04B 19/22; F04B 29/00

[52] U.S. Cl. ..... 417/214; 417/462; 123/501

[58] Field of Search ..... 123/501, 502, 504; 417/214, 462

[56] References Cited

U.S. PATENT DOCUMENTS

| | | | |
|---|---|---|---|
| 3,338,168 | 8/1967 | Davis | 417/214 |
| 3,847,509 | 11/1974 | Bonin | 417/214 |
| 3,883,270 | 5/1975 | Baxter | 417/214 |
| 4,055,387 | 10/1977 | Potter | 417/264 |
| 4,098,249 | 7/1978 | Mowbray | 417/221 |
| 4,173,959 | 11/1979 | Sosnowski et al. | 123/501 |

*Primary Examiner*—William L. Freeh

[57] ABSTRACT

A fuel pumping apparatus includes a rotary distributor member including bores locating pump plungers. The plungers are engaged by shoes carrying rollers. An actuating member has a leading flank and a trailing flank and is movable along a path parallel to a tangent to the bore containing the distributor member. The leading flank is movable into the path of the rollers to impart inward movement to the rollers and the associated plungers. The position of the actuating member is adjustable to determine the amount of fuel pumped by the plungers.

19 Claims, 11 Drawing Figures

Figure 1:
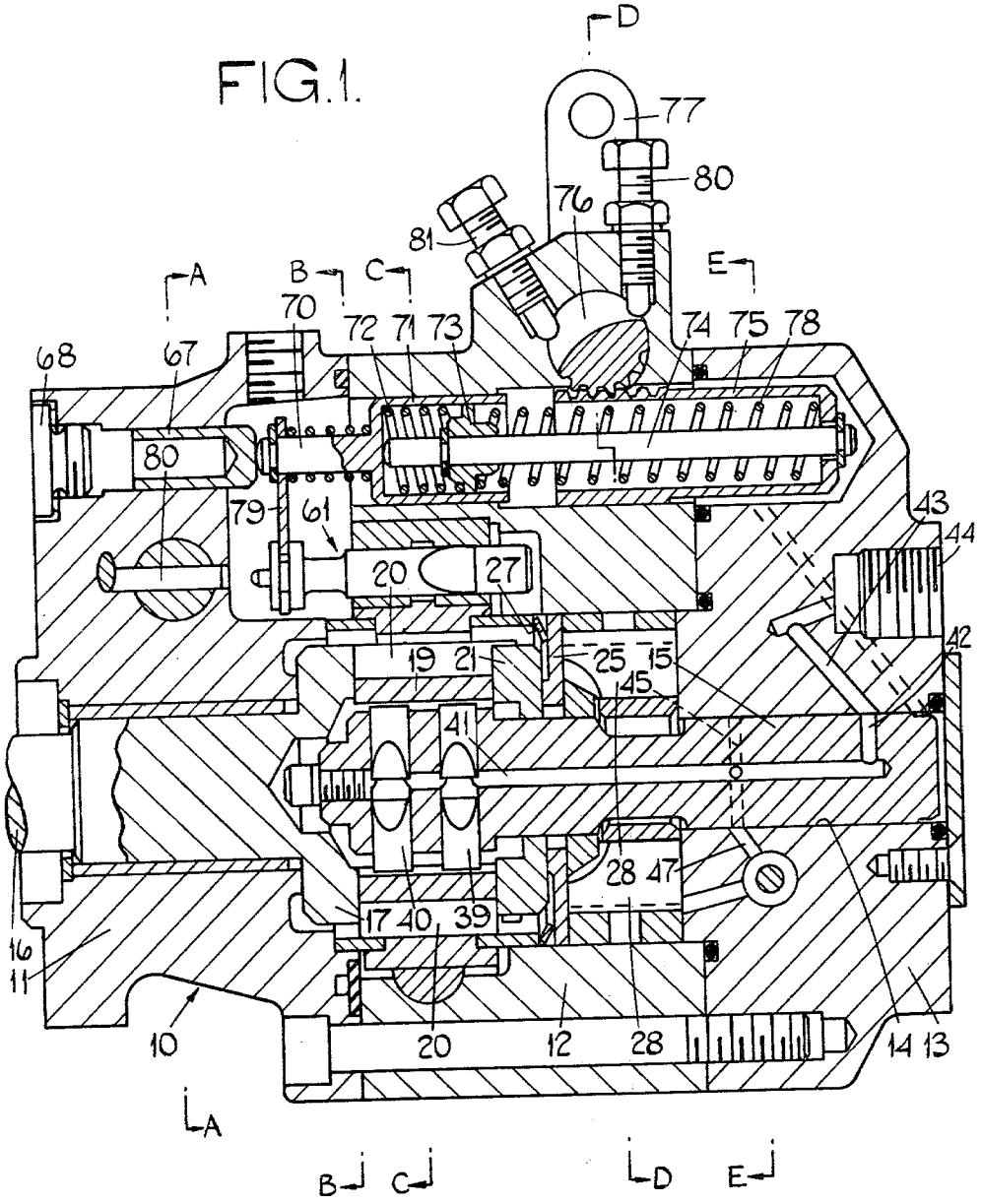

77
80
76
34
75
31
33
29
36
37
38
35
28
30
32

FIG.9.
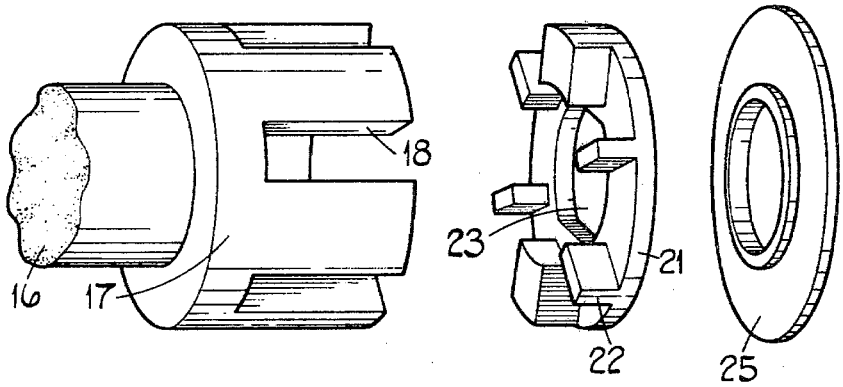
FIG.10.
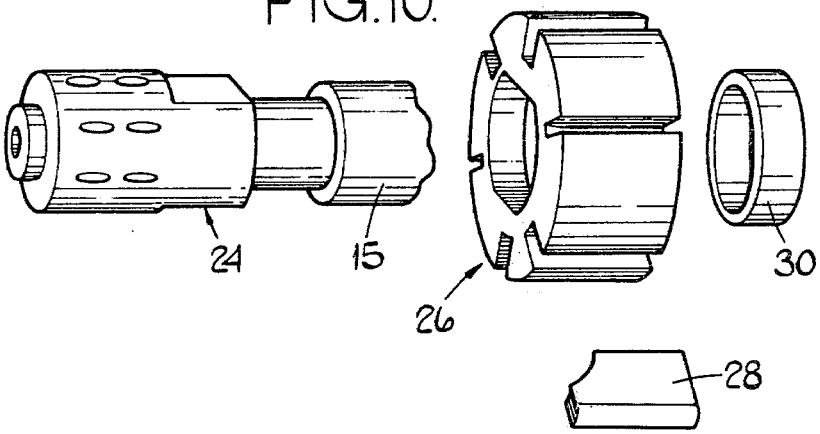
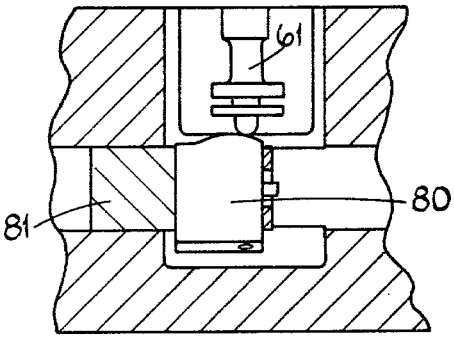
FIG.11.

FUEL INJECTION PUMPING APPARATUS

This invention relates to a fuel injection pumping apparatus for supplying fuel to a multi-cylinder internal combustion engine and of the kind comprising a rotary distributor member located within a bore in a housing and arranged in use to be driven in timed relationship with an associated engine, a plurality of outlets formed in the housing and extending to the periphery of the distributor member, said outlets in use being connected to the injection nozzles of the associated engine respectively, a delivery passage formed in the distributor member for registration in turn with said outlets, a plurality of outwardly extending cylinders formed within the distributor member and communicating at their inner ends with said delivery passage, pump plungers in said cylinders respectively, means for imparting inward movement to said plungers in turn as the distributor member rotates so that fuel is supplied to said outlets in turn, and further means for supplying fuel to said cylinders.

In a known form of such apparatus fixed height cams are employed to impart inward movement to the plungers. The cams have a sloping leading flank so that the instant at which a cam starts to move a plunger inwardly, depends upon the position of the plunger within its cylinder following the supply of fuel to the cylinder. The instant of the start of fuel delivery therefore depends upon the amount of fuel supplied to the cylinder which may be controlled by a throttle and in practice the greater the amount of fuel supplied to the cylinder then the earlier will be the commencement of delivery of fuel. The timing/fuel quantity characteristic produced by this inherent variation in the timing of delivery of fuel is not always suitable for operation of the associated engine and in many cases it is necessary to compensate for the inherent timing variation by arranging that the cam is angularly movable.

Other forms of the apparatus arrange for the cylinders to be fully filled with fuel prior to the inward movement of the plungers therein. In this manner the commencement of fuel delivery by the plungers is fixed and the control of the amount of fuel delivered and also such timing adjustment as may be required, may be effected by means of a spill muff surrounding an exposed portion of the distributor member and controlling the opening and closing of a spill port. The provision of such a muff increases the leakage encounted during operation of the apparatus and also adds to the length of the distributor member.

The object of the present invention is to provide an apparatus of the kind specified in a simple and convenient form.

According to the invention in an apparatus of the kind specified said means comprises an actuating member movable in the housing, said actuating member having a leading flank which projects into the path of the outer ends of said plungers or parts engaging therewith, said leading flank effecting inward movement of the plungers in turn as the distributor member rotates, said actuating member being movable in a direction parallel to a tangent to said bore so as to vary the extent of inward movement of the plungers by said leading flank.

According to a further feature of the invention said flank is parallel to said tangent whereby the delivery of fuel by the apparatus occurs at the same time irrespective of the position of the actuating member.

According to a further feature of the invention said actuating member is located in a support which is angularly movable about the axis of rotation of the distributor member whereby the timing of delivery of fuel can be adjusted.

Figure 2:
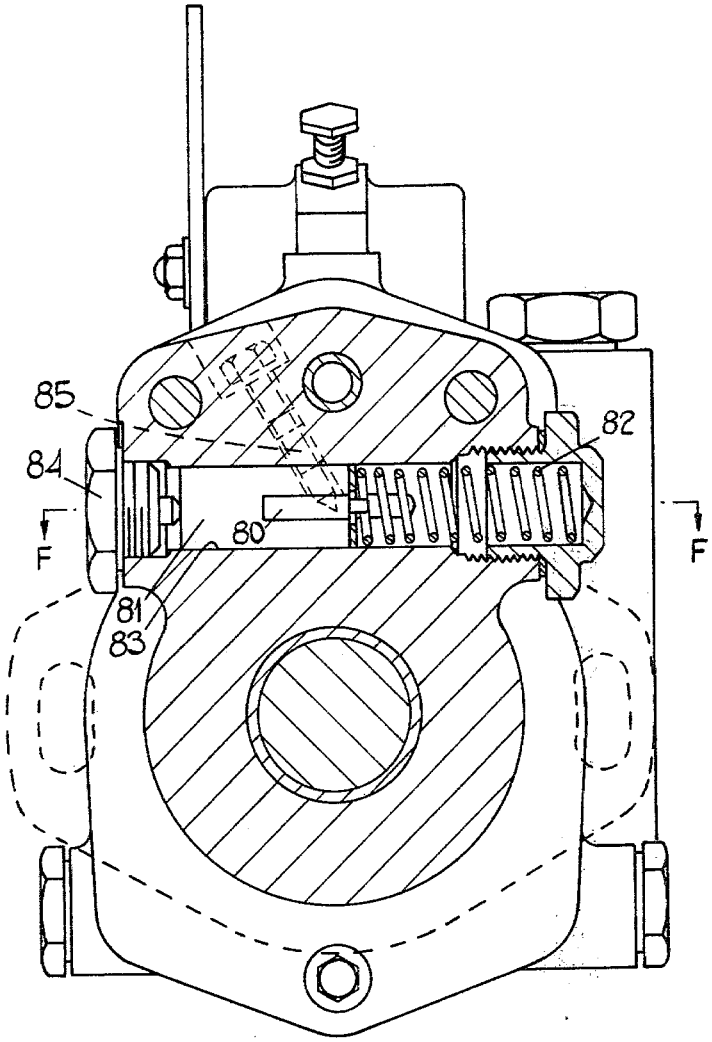
Figure 3:
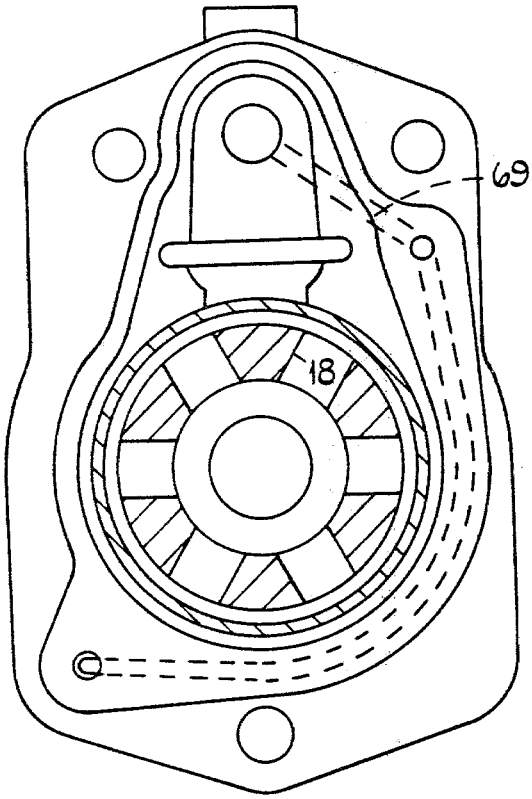
Figure 4:
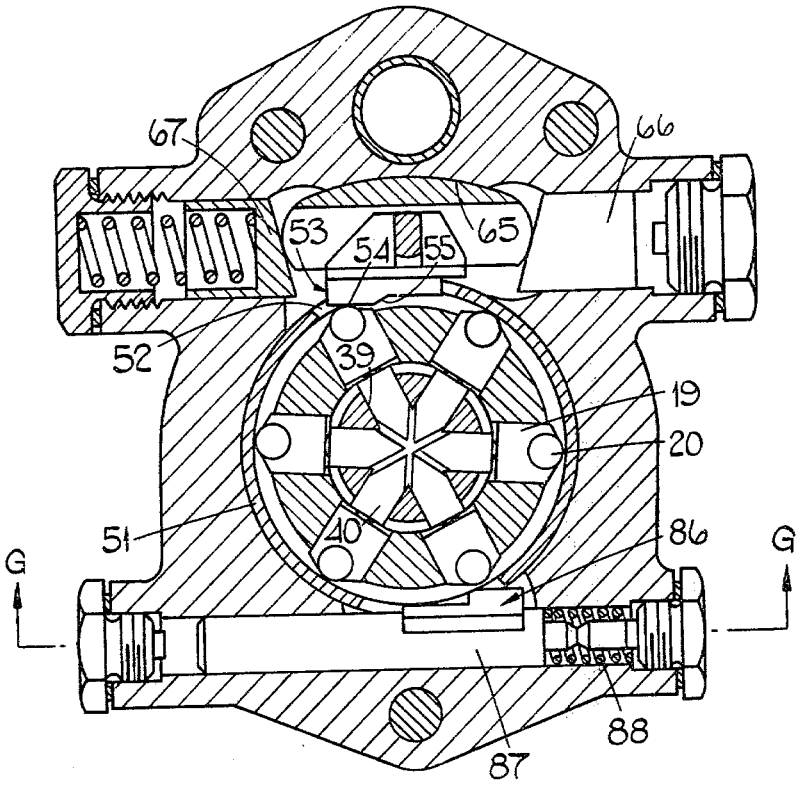
Figure 8:
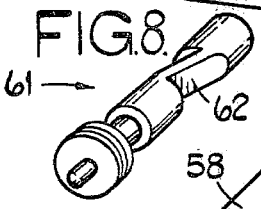
Figure 8:
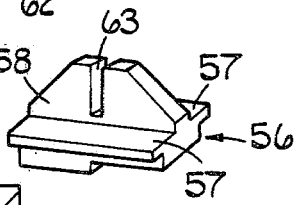
Figure 7:
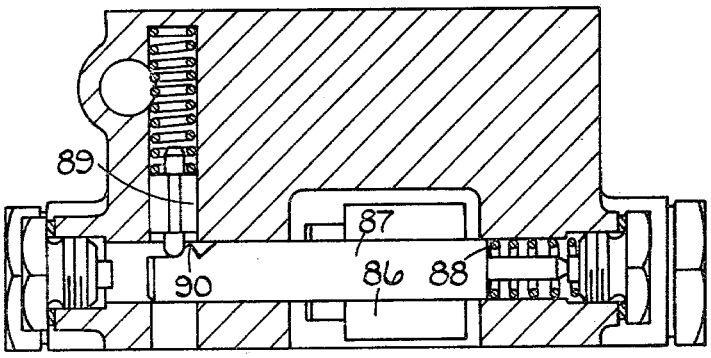

An example of a fuel injection pumping apparatus in accordance with the invention will now be described with reference to the accompanying drawings in which:

FIG. 1 is a sectional side elevation of this apparatus,

FIGS. 2, 3, 4, 5, 6 are sections generally on the lines AA, BB, CC, DD and EE of FIG. 1, FIG. 7 is a section on the line GG of FIG. 4, FIG. 8 is a perspective and exploded view of three parts of the apparatus seen in the preceding drawings, FIG. 9 is an exploded perspective view of a further three parts of the apparatus seen in the earlier drawings, FIG. 10 shows additional parts in perspective of the apparatus and, FIG. 11 is a section along the line FF of FIG. 2.

With reference to FIG. 1 of the drawing the apparatus comprises the housing generally indicated at 10 and which is formed in three parts 11, 12 and 13. The part 13 of the apparatus is provided with a bore 14 in which is located a rotary cylindrical distributor member 15. The distributor member is connected to the drive shaft 16 which is mounted for angular movement in the part 11 of the housing and which extends to the outer periphery of the housing so as to be capable of connection to a drive component of the associated engine. A portion of the drive shaft is seen in FIG. 9 and it will be seen to have an enlarged cup-shaped portion 17 which is provided with a plurality in this case, 6 radial slots 18. The slots 18 are of equal circumferential width and is shown in FIG. 4, accommodate shoes 19 which carry rollers 20 respectively. The shoes 19 are held against axial movement by a plate 21 having lateral projections 22 which extend into the slots 18 respectively. Two of the projections are equal in circumferential width to the slots 18 and the plate 21 is provided with a non-circular opening 23 which is located about a complementarily shaped portion 24 of the distributor member 15. The distributor member is therefore driven by the plate 21 which in turn is driven by the input shaft.

Located adjacent the plate 21 is a further plate 25 against which is located the rotor 26 of a vane type feed pump. The rotor 26 is provided with a non-circular opening complementary to the non-circular portion 24 of the distributor member so that the rotor is driven by the distributor member. The rotor 26 is held by a dished washer 27 (FIG. 1) against the end face of the housing portion 13 and the rotor is provided with radial slots which receive vanes 28 respectively.

The outer edges of the vanes 28 engage the internal peripheral surface of a sleeve 29 located within the central portion of the housing and which has its inner peripheral surface eccentrically disposed relative to the axis of rotation of the rotor. Moreover, the inner edges of the vanes 28 are engaged by a location ring 30 which surrounds the distributor member.

Figure 5:
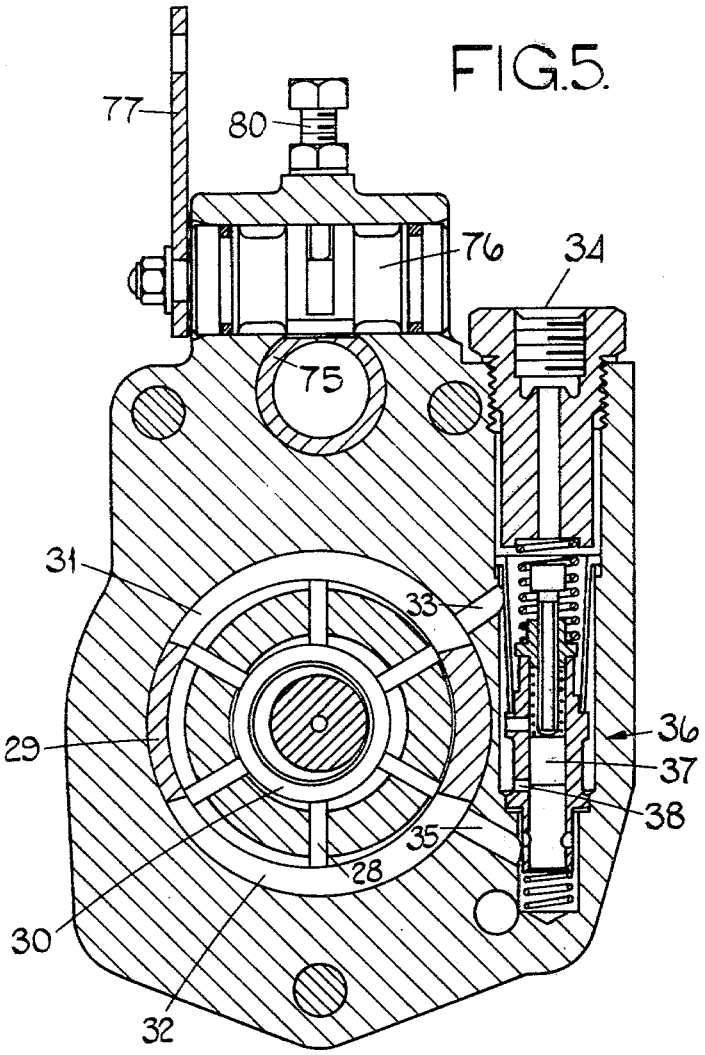
Figure 6:
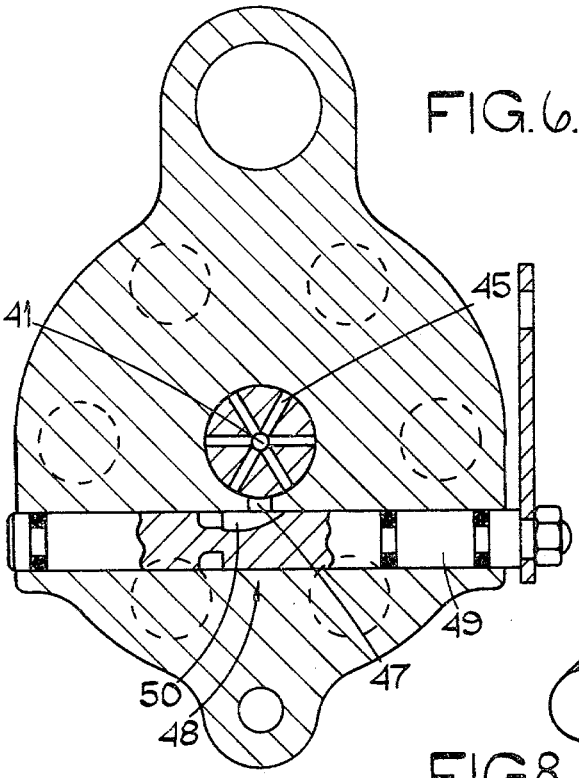
Figure 6:
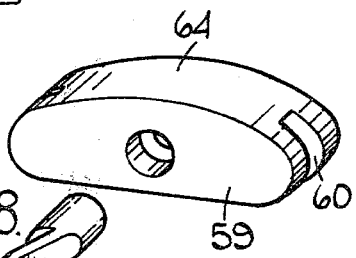

The sleeve 29 is provided with arcuate ports 31, 32 and as the distributor member rotates, in the anti-clockwise direction as seen in FIG. 5, fuel is drawn into the space between adjacent vanes from the port 31 and is discharged through the port 32. The port 31 communicates with a fuel inlet passage 33 which is connected with a fuel inlet 34 which in use, is connected to a source of fuel. The port 32 communicates with an outlet passage 35 which can communicate with the inlet passage 33 by way of a relief valve 36. The relief valve includes a valve member 37 movable by the fuel under pressure against the action of a spring, to expose to a greater or lesser extent, a relief port 38 which communicates with the aforesaid inlet passage 33. The valve 36 controls the fuel pressure in the port 32 and passage 35 in such a manner that it varies in accordance with the speed at which the distributor member is driven.

The portion of the distributor member 15 which lies within the cup shaped portion 17 of the drive shaft is provided with a plurality of radially disposed and circumferentially spaced cylinders 39. In the example described there are two groups of cylinders which each group containing six cylinders. The cylinders of the two groups are aligned and each cylinder contains a pumping plunger 40 the outer ends of which bear against respective shoes 19.

The inner ends of the cylinders communicate with a longitudinal passage 41 which extends within the distributor member and terminates in a single delivery passage 42 which extends to the periphery of the distributor member. The passage 42 is adapted to register in turn and as the distributor member rotates, with a plurality in this case 6, of outlet ports 43 formed in the end portion 13 of the housing. The outlet passages communicate respectively with outlets 44 on the periphery of the housing portion 13, the outlets in use, being connected to the fuel injection nozzles of the associated engine. Moreover, the passage 41 also communicates with a plurality in this case 6, of inlet passages 45 which extend to the periphery of the distributor member for registration in turn with an inlet port 47 formed in the end part 13 of the housing and which communicates with the port 32 by way of a shut off valve 48 which is more clearly seen in FIG. 6. The valve 48 comprises a shaft 49 which is angularly movable from exterior of the housing, and which is provided with an axially extending groove 50 which can be brought into communication with the port 47 and which at one end communicates with a circumferential groove which is in constant communication with the port 32. It will be seen that as the shaft 49 is moved angularly, the groove 50 is moved out of communication with the port 47 thereby to prevent the supply of fuel.

The operation of the apparatus so far described is as follows; assume for the moment that a pair of plungers are moved inwardly. Such inward movement occurs only when the delivery passage 42 is in communication with an outlet 44 and as inward movement of the plungers occur, fuel is delivered by the apparatus to the respective injection nozzle. As the distributor member continues to rotate the passage 42 is moved out of register with the respective outlet 44 and one of the inlet passages 45 moves into register with the inlet port 47. When this occurs fuel under pressure is supplied to the passage 41 and effects outward movement of the plungers previously moved inwardly. Thereafter, the cycle is repeated with fuel being supplied to the outlet 44 in turn.

Referring now to FIG. 4 the rollers 20 engage with the internal peripheral surface of a sleeve 51 secured within the central housing portion 12. At one point however, the sleeve 51 is provided with a circumferentially extending slot 52 through which extends an actuating member 53. The member 53 has a leading flank 54 which terminates in an inclined portion which can be conveniently called the trailing flank indicated at 55 in FIG. 4. The actuating member is formed on a piece 56 (FIG. 8) which includes a pair of guide surfaces 57 faced by an upstanding rib 58. The surfaces 57 engage complementary surfaces on a support 59, the rib 58 being accommodated within a slot 60 formed in the support. The surfaces 57 are disposed parallel to a tangent to the bore 14 and therefore also parallel to a tangent to the circle defined by the inner periperhal surface of the sleeve 51. The leading flank 54 is also parallel to the surfaces 57 and similarly parallel to the same tangent. When therefore the actuating member is moved laterally as seen in FIG. 4, whilst contact of a roller with the leading flank will occur at the same angular position of the distributor member, the extent by which the roller and therefore the shoe and associated plunger, is moved inwardly will depend upon the axial position of the flank. Thus lateral movement of the actuating member will effect variation of the quantity of fuel delivered by the apparatus but it will not effect the instant at which the delivery occurs.

The actuating member is moved laterally as seen in FIG. 4, by means of a push member 61 shown in FIG. 8 and which has an intermediate inclined portion 62 which locates within a complementarily inclined slot 63 formed in the rib 58. The push member 61 is slidably axially within drillings provided in the support 59 and the axial position of the push member 61 and thereby the position of the actuating member is determined by a governor mechanism which will be described.

In order to vary the timing of delivery of fuel, the support 59 is angularly movable about the axis of rotation of the distributor member. The surfaces of the support 59 which engage the surfaces 57 is flat but the opposite surface identified at 64, is curved and engages against a complementary surface 65 seen in FIG. 4, defined in the central part 12 of the housing. The support 59 is biased into contact with an adjustable stop 66 by means of a spring loaded plunger 67. Both the plunger 67 and the stop 66 have inclined surfaces so that a reaction force is generated which urges the surface 64 of the support into engagement with the surface 65.

The stop 66 is in fact constituted by a fluid pressure operable piston which can be subjected to the pressure produced by the vane pump. The angular setting of the support 59 will therefore depend upon the speed at which the apparatus is driven and the timing of delivery of fuel will therefore vary in accordance with the speed. It should be noted that for a given setting of the actuating member relative to the support, the same quantity of fuel will be delivered irrespective of the angular position of the support.

Turning now to FIG. 1 of the drawings, the position of the push member 61 is determined by a governor mechanism which includes a piston 67 located within a bore formed in the part 11 of the housing. The outer end of the bore is closed by a plug 68 and fuel is supplied to the space between the piston 67 and the plug 68 by way of a passage 69 which is shown in dotted outline in FIG. 3. The passage 69 communicates with the outlet passage 35 seen in FIG. 5. The piston 67 engages the end of a rod 70 which is secured to the end of a cup-shaped member 71 slidable within a bore defined in the central part 12 of the housing. The member 71 accommodates a first coiled compression spring 72, one end of which bears against the base wall of the member 71 and the other end of which bears against an abutment 73 slidably mounted upon a further rod 74. The rod 74 is supported in an aperture formed in the base wall of a further cup-shaped member 75 the outer peripheral surface of which is provided with teeth for engagement with complementary teeth formed on an angularly movable shaft 76 which extends to the periphery of the housing and which has an actuating lever 77 secured thereto. Within the cup-shaped member 75 is a further coiled compression spring 78 which engages the base wall of the member 75 and the abutment 73. Furthermore, the rod 70 is provided with a circlip at its free end which constitutes an abutment surface for a link 79 at one end engaged about the rod 70 and having its other end forked for engagement between a pair of shoulders defined on the push member 61. A spring surrounds the rod 70 and biases the link 79 into contact with the circlip. In operation the spring 72 together with the piston 67 constitute a governor which is operable at idling speed, to control the position of the push member 61 and therefore the amount of fuel which is supplied to the engine. As the speed of the engine decreases, the spring 72 will urge the push member 61 towards the left as seen in FIG. 1 thereby increasing the amount of fuel supplied to the engine and vice versa. The extent of compression of the spring 72 is determined by the abutment of the rod 74 with the cup-shaped member 71. In the example the spring 78 is pre-loaded owing to the fact that the abutment 73 is in engagement with a circlip carried by the rod 74. The position of the push member 61 when the engine speed is above idling speed will, therefore, be determined by the position of the cup-shaped member 75 and this is determined by the shaft 76 which is controlled by the engine operator.

The operator can therefore control directly the position of the push member 61 and hence the amount of fuel supplied to the engine. The spring 78 is provided for the purpose of controlling the allowed maximum speed of the engine and when this is approached the force exerted by the piston 67 overcomes the preload of the spring 78 and the push member 61 is moved towards the right to reduce the amount of fuel supplied to the engine irrespective of the setting of the cup-shaped member 75. The governor illustrated is therefore what is called a two speed governor. In FIG. 1 the shaft 76 is shown in the idling position this being determined by an adjustor 80. The maximum fuel setting of the shaft 76 is determined by a further adjustor 81, the shaft 76 having a suitably shaped recess which defines surfaces for engagement with the adjustors 80 and 81.

If the circlip on the rod 74 is omitted the governor becomes an all speed governor with the force exerted by the spring 78 being determined by the position of the cup-shaped member and hence the operator. In this case the adjustor 81 determines the maximum speed of the associated engine. As the force exerted by the spring 78 is increased the push member 61 will be moved to increase the amount of fuel supplied to the engine, the piston 67 being moved towards the left in this process. As the speed of the engine increases, however, the piston will move against the action of the spring 78 to control the engine speed at a value appropriate to the setting of the shaft 76.

If the timing of delivery of fuel is adjusted by the piston 66, the link 79 can accommodate the angular movement of the support 59 which takes place as a result of the movement of the piston 66.

In order to control the maximum amount of fuel which is supplied to the engine, a maximum fuel stop is provided and this is seen more clearly in FIGS. 2 and 11. In FIG. 11 the end of the push member 61 is shown to be in engagement with the contoured surface of a stop member 80. It should be noted that the position of the parts in FIG. 11 does not correspond to the position of the parts seen in FIG. 1. The stop member 80 is carried by a piston 81 which is movable by fuel under pressure, against the action of a spring 82. The piston and spring are located in a bore 83 which is formed in the end housing portion 11 and extending at right angles to the axis of the drive shaft 16. The end of the bore remote from the spring is closed by a plug 84 and fuel under pressure is supplied to the space defined between the piston 81 and the plug 84 through a branch passage from the aforesaid passage 69. The stop member 80 is located within a slot formed in the piston and its end surface remote from the push member 61 is engaged by an adjusting screw shown in dotted outline at 85 in FIG. 2. The surface of the stop member 80 which is contacted by the end of the push member is contoured so as to provide the desired variation in the maximum amount of fuel which can be supplied to the engine as the speed varies.

It is well known that compression ignition engines require an excess of fuel to be supplied for starting purposes. This could be achieved by providing a suitable shape on the stop member 80 but in the construction shown in the drawings it is preferred to actuate two further plungers for this purpose. In order to achieve this and as shown in FIGS. 4 and 7, a further actuating member 86 is provided and which is carried by a piston 87. The piston is biased by means of a spring 88 to a position in which the further actuating member 86 will actuate an additional pair of plungers at substantially the same time as the main pair of plungers are actuated by the actuating member 53. The piston 87 is urged against the action of the spring 88 by fuel under pressure applied to it from the outlet of the vane pump. As seen in FIG. 7, a latch mechanism is provided to retain the piston 87 in a position such that the actuating member 86 does not actuate the pistons and the latch means comprises a spring loaded plunger 89 engageable with a projection 90 formed on the surface of the piston 87. The latch member is able to retain the piston 87 against the action of the spring providing it is assisted by fuel under pressure. When the associated engine is stopped, the fuel pressure falls to zero and the spring 88 is able to move the piston 87 against the restraining force exerted by the latch. As a result when it is next required to start the engine the actuating member 86 is in a position to effect inward movement of the pistons and therefore excess fuel is supplied to the associated engine until the fuel pressure applied to the piston 87 is sufficient to overcome the restraining force exerted by the latch. When this occurs, the piston 87 moves to the position shown in FIG. 7 and the supply of excess fuel ceases.

The additional actuating member may be used to modify the speed/fuel delivery characteristic of the apparatus and thereby to make the apparatus particularly suitable for supplying fuel to the engine of an earth moving vehicle.

Moreover, the additional actuating member 86 may be positioned such that it imparts a small inward movement to a pair of plungers in advance of the inward movement of another pair of plungers by the actuating member 53. This small movement will cause a pilot injection of fuel to the associated engine. If pilot injection is to be provided in this manner, then the actuating member 86 will also need to be angularly movable about the axis of rotation of the distributor member in order to provide the desired separation of the timing of the pilot and main quantities of fuel when the support 59 is moved angularly to vary the timing of the main quantity of fuel.

In the apparatus described each delivery of fuel is effected by inward movement of two plungers ignoring for the moment the actuating member 86. It will be obvious that if the engine has a smaller number of cylinders for example four, it is possible to increase the size of each pumping plunger so that two sets of plungers may not be required. Engines with an unequal firing order can be supplied with fuel by suitable positioning of the cylinders containing the plungers. Moreover, the apparatus can be utilised to supply fuel to an engine having an odd number of cylinders.

If desired a delivery valve may be provided in the distributor member or individual delivery valves in the outlets 44 respectively.

We claim:

1. A fuel injection pumping apparatus for supplying fuel to a multi-cylinder internal combustion engine comprising a rotary distributor member located within a bore in a housing and arranged in use to be driven in timed relationship with an associated engine, a plurality of outlets formed in the housing and extending to the periphery of the distributor member, said outlets in use being connected to the injection nozzles of the associated engine respectively, a delivery passage formed in the distributor member for registration in turn with said outlets, a plurality of outwardly extending cylinders formed within the distributor member and communicating at their inner ends with said delivery passage, pump plungers in said cylinders respectively, means for imparting inward movement to said plungers in turn as the distributor member rotates so that fuel is supplied to said outlets in turn, further means for supplying fuel to said cylinders, said means for imparting inward movement to said plungers comprising an actuating member for varying the extent of inward movement of the plungers, the actuating member being movable in the housing, said actuating member having a leading flank which extends parallel to a tangent to said bore and which member projects into the path of the outer ends of said plungers or parts engaging therewith, said leading flank effecting inward movement of the plungers in turn as the distributor member rotates, said actuating member being movable along a movement path which extends in a direction parallel to said tangent to said bore so that the extent of inward movement of the plungers by said leading flank varies according to the position of said actuating member along said movement path.

2. An apparatus according to claim 1 in which said parallel orientation of said flank causes the delivery of fuel by the apparatus to occur at the same time irrespective of the position of the actuating member.

3. An apparatus according to claim 2 in which said actuating member is located in a support which is angularly movable about the axis of rotation of the distributor member whereby the timing of delivery of fuel by the apparatus can be adjusted.

4. An apparatus according to claim 2 including a piece defining said actuating member, a support member for said piece, a guide surface defind on said piece and a complementary surface on said support member, said surfaces extending substantially parallel to said tangent, guide means carried by the support member and said piece, and means carried by said support member for effecting movement of the piece in a direction parallel to said tangent.

5. An apparatus according to claim 4 in which said guide means comprises a slot and a rib located in said slot, the slot being formed in said support member and the rib being defined on said piece, the rib and slot extending in a plane at right angles to the axis of the distributor member.

6. An apparatus according to claim 5 in which the means for effecting movement of the piece comprises a push member slidable within drillings formed in the support member, said drilling being disposed substantially parallel to the axis of the distributor member, a reduced portion defined by said push member, said reduced portion being inclined to the axis of said drillings, and a slot formed in said rib, the sides of said slot engaging said reduced portion whereby as the push member is moved axially in said drillings the actuating member will be moved relative to the support member.

7. An apparatus according to claim 6 including an engine speed responsive device in the housing and link means coupling said speed responsive device to the push member whereby said device controls the axial setting of the push member.

8. An apparatus according to claim 7 including an adjustable stop positioned in the housing for engagement by an end of said push member.

9. An apparatus according to claim 8 including a resiliently loated piston mounting said adjustable stop, the setting of said piston depending upon the speed of the associated engine.

10. An apparatus according to claim 7 including a further actuating member having a leading flank, said further actuating member being movable within the housing so that said flank can move into the path of the outer ends of said plungers or parts engaging therewith at a different position about the axis of rotation of the distributor member.

11. An apparatus according to claim 10 in which said further actuating member is positioned so that two plungers at different angular positions about the axis of the distributor member will be moved inwardly at substantially the same time.

12. An apparatus according to claim 11 in which the inward movement of one of the plungers takes place slightly in advance of that of the other plunger whereby the rate of fuel delivery by the apparatus is varied.

13. An apparatus according to claim 11 in which said further actuating member is movable by a fluid pressure operable piston which is biased by a spring to an operative position in which the flank on the further actuating member is positioned to effect inward movement of a plunger, the piston being moved to an inoperative position in which the said flank is removed from the path of movement of the ends of the plungers by the action of fluid pressure, and detent means being provided to temporarily restrain the movement of the piston from the operative to the inoperative position and vice versa.

14. An apparatus according to claim 9 including a feed pump operable to supply fuel under pressure, valve means operable to control the output pressure of the feed pump so that it varies in accordance with the speed at which the distributor member rotates, the output pressure of the feed pump being applied to said piston or pistons.

15. An apparatus according to any one of claims 4 to 9 in which said support member is mounted for angular movement about the axis of the distributor member whereby the timing of delivery of fuel by the apparatus can be adjusted.

16. An apparatus according to claim 15 in which the support member is provided with a curved surface for engagement with a complementary surface defined in the housing.

17. An apparatus according to claim 16 including means disposed at opposite ends of said support member for urging said curved and complementary surfaces into engagement with each other.

18. An apparatus according to claim 17 in which the means at one end of the support member comprises a spring loaded plunger and the means at the other end of the support member comprises a stop in the form of a fluid pressure operable piston, said plunger and piston having inclined surfaces for engagement with the ends of the support member whereby reaction forces are generated urging the curved and complementary surfaces into engagement.

19. An apparatus according to claim 18 in which the pressure applied to the fluid pressure operable piston is variable whereby the angular setting of the support member about the axis of the distributor member can be varied.

* * * * *